United States Patent [19]

Ashok et al.

[11] Patent Number: 4,642,146

[45] Date of Patent: Feb. 10, 1987

[54] ALPHA COPPER BASE ALLOY ADAPTED TO BE FORMED AS A SEMI-SOLID METAL SLURRY

[75] Inventors: Sankaranarayanan Ashok, Bethany; John F. Breedis, Trumbull, both of Conn.

[73] Assignee: Olin Corporation, New Haven, Conn.

[21] Appl. No.: 786,564

[22] Filed: Oct. 11, 1985

Related U.S. Application Data

[63] Continuation-in-part of Ser. No. 599,107, Apr. 11, 1984, Pat. No. 4,569,702.

[51] Int. Cl.[4] ..... C22C 9/01

[52] U.S. Cl. ..... 148/414; 420/477; 420/478; 420/479; 420/480; 420/490

[58] Field of Search ..... 148/414; 420/479, 480, 420/477, 490

[56] References Cited

U.S. PATENT DOCUMENTS

| | | | |
|---|---|---|---|
| 44,086 | 9/1864 | Farmer | 420/479 |
| 1,736,654 | 11/1929 | Lay et al. | 420/481 |
| 1,783,139 | 11/1930 | Philippossian | 420/479 |
| 1,792,944 | 2/1931 | Vaders | 420/479 |
| 1,815,071 | 7/1931 | Price | 420/479 |
| 1,906,567 | 5/1933 | Fritschle | 420/479 |
| 2,031,315 | 2/1936 | Jennison | 420/486 |
| 2,034,562 | 3/1936 | Davis et al. | 420/479 |
| 2,061,897 | 11/1936 | Crampton et al. | 148/433 |
| 2,074,604 | 3/1937 | Bolton et al. | 420/487 |
| 2,101,087 | 12/1937 | Munson | 420/479 |
| 2,101,625 | 12/1937 | Munson | 420/479 |
| 2,101,626 | 12/1937 | Munson | 420/479 |
| 2,101,930 | 12/1937 | Davis et al. | 420/479 |
| 2,144,279 | 1/1939 | Whitman | 420/471 |
| 2,190,536 | 2/1940 | Staiger | 148/11.5 R |
| 2,236,975 | 4/1941 | Muller et al. | 420/522 |
| 2,430,419 | 11/1947 | Edens | 420/486 |
| 2,789,900 | 4/1957 | Hannon | 420/486 |
| 2,851,353 | 9/1958 | Roach et al. | 420/486 |
| 3,156,589 | 11/1964 | Klement | 148/3 |
| 3,364,016 | 1/1968 | Mikawa | 420/486 |
| 3,416,915 | 12/1968 | Mikawa | 420/486 |
| 3,635,702 | 1/1972 | Badia et al. | 420/422 |
| 3,902,544 | 9/1975 | Flemings et al. | 164/122 X |
| 3,936,298 | 2/1976 | Mehrabian et al. | 148/400 |
| 3,948,650 | 4/1976 | Flemings et al. | 75/10 R X |
| 3,951,651 | 4/1976 | Mehrabian et al. | 420/590 |
| 3,954,455 | 5/1976 | Flemings et al. | 148/400 |
| 4,073,667 | 2/1978 | Caron et al. | 148/12.7 C |
| 4,106,956 | 8/1978 | Bercovici | 148/11.5 A |
| 4,116,686 | 9/1978 | Mravic et al. | 148/11.5 C X |
| 4,401,488 | 8/1983 | Prinz et al. | 148/435 |
| 4,415,374 | 11/1983 | Young et al. | 148/2 |
| 4,434,837 | 3/1984 | Winter et al. | 164/468 |
| 4,494,461 | 1/1985 | Pryor et al. | 164/900 |

FOREIGN PATENT DOCUMENTS

| | | | |
|---|---|---|---|
| 2309077 | 10/1974 | Fed. Rep. of Germany . | |
| 53-41096 | 10/1978 | Japan . | |
| 2112676 | 7/1983 | United Kingdom | 148/11.5 C |
| 206097 | 12/1967 | U.S.S.R. | 420/486 |

OTHER PUBLICATIONS

"Rheocasting Processes", by Flemings et al., *AFS International Cast Metals Journal*, Sep. 1976, pp. 11–22.

"Die Casting Partially Solidified High Copper Content Alloys", by Fascetta et al., *AFS Cast Metals Research Journal*, Dec. 1973, pp. 167–171.

Alexander et al., *Journal of the Institute of Metals*, vol. 61, pp. 83–102, vol. 63, 1938, pp. 163–189 and vol. 64, 1939, pp. 217–230., Articles on "Copper-Rich Nickel Aluminum Copper Alloys".

*Primary Examiner*—Veronica O'Keefe

*Attorney, Agent, or Firm*—Paul Weinstein; Howard M. Cohn; Barry L. Kelmachter

[57] ABSTRACT

A copper base alloy capable of forming a microstructure comprising a plurality of discrete particles in a surrounding metal matrix having a lower melting point than the particles. The alloy consists essentially of from about 3% to about 6% nickel, from about 2% to about 4.25% aluminum, from about 0.25% to about 1.2% silicon, from about 5% to about 15% zinc, up to about 5% iron and the balance essentially copper. When iron is included in an amount from about 3% to about 5% and zinc is restricted to a range of from about 8% to about 10%, the alloy is capable of forming the desired structure in the as-cast condition using a process which does not include stirring during casting.

13 Claims, 3 Drawing Figures

ALPHA COPPER BASE ALLOY ADAPTED TO BE FORMED AS A SEMI-SOLID METAL SLURRY

This application is a continuation-in-part of U.S. patent application Ser. No. 599,107, filed Apr. 11, 1984 by Ashok et al. for "A Copper Base Alloy Adapted To Be Formed As A Semi-Solid Metal Slurry" U.S. Pat. No. 4,569,702.

This application also is related to U.S. patent application Ser. No. 598,960, filed Apr. 11, 1984 by Ashok et al. for a "Beta Copper Base Alloy Adapted To Be Formed As A Semi-Solid Metal Slurry And A Process For Making Same".

The present invention relates to a copper base alloy which is adapted to be formed as a semi-solid metal slurry. The forming operation preferably comprises press forging. The alloy is precipitation hardenable in the forged state to provide desired levels of strength. The alloys of this invention find particular application in articles such as cartridge cases although they may be useful in a wide variety of articles.

In the manufacture of thin walled elongated high strength members such as cartridge cases, it is highly desirable to form the member from a material having physical properties capable of achieving certain desired objectives, i.e. sufficient fracture toughness to withstand the shock associated with firing, good formability so that the member can expand during firing and contract afterwards, high strength properties to form a reusable cartridge, etc.

In U.S. Pat. No. 4,494,461 to Pryor et al. for a "Method And Apparatus For Forming A Thixoforged Copper Base Alloy Cartridge Casing" and assigned to the assignee of the present invention, there is disclosed a range of copper base alloys consisting essentially of from about 3% to about 20% nickel and from about 5% to about 10% aluminum and the remainder copper, which are adapted to be formed by forging a semi-solid metal slurry of the alloy. The formed part may be age hardened to provide high strength properties. Pryor et al. also disclose the application of the material and processing therein to the formation of thin walled members such as cartridge cases.

In U.S. patent application Ser. No. 616,081 to Pryor et al., which is a Division of the Pryor et al. patent, there is claimed a copper base alloy having a structure comprising a plurality of discrete particles in a surrounding metal matrix. The particles and the matrix are comprised such that when the alloy is heated to a desired temperature the alloy forms a semi-solid slurry wherein the matrix is in the molten condition comprising from about 5% to about 40% liquid and the particles are within the liquid matrix. The alloy consists essentially of about 3% to about 20% nickel, about 5% to about 10% aluminum and the balance essentially copper.

While the alloys of Pryor et al. have been found to be well suited to this application, it has now been found that the addition of silicon, zinc and preferably iron to a copper base alloy including nickel and aluminum within specific ranges provides an alloy having improved properties for forming as a semi-solid metal slurry. The addition of silicon and zinc lower the melting point of the alloy while maintaining or increasing the temperature difference between its liquidus and solidus temperatures. Silicon also improves the aging kinetics of the alloy and reduces its quench sensitivity. Silicon also provides some improvement in conductivity.

It is known that alloys which are capable of forming a semi-solid metal slurry can have thixotropic properties which are beneficial in improving tool life and reducing thermal shock affects during processing. A metal or alloy composition which is suitable for forming while in the state of a semi-solid slurry having thixotropic properties generally has a microstructure comprising solid discrete particles in a surrounding matrix having a lower melting point than the particles. With such an alloy the surrounding matrix is solid when the metal composition is fully solidified and is liquid when the metal composition comprises a semi-solid slurry made up of the solid discrete particles in the molten surrounding matrix.

The microstructure of the copper base alloy may be formed by any of a number of techniques. One technique which is particularly preferred in accordance with the present invention involves casting the alloy while it is agitated or stirred, preferably by electromagnetic means. This technique which has sometimes been referred to as "rheocasting" or "thixocasting" is exemplified in U.S. Pat. Nos. 3,902,544, 3,948,650 and 3,954,455 all to Flemings et al., 3,936,298 and 3,951,651 both to Mehrabian et al., 4,106,956 to Bercovici and 4,434,837 to Winter et al. and the articles "Rheocasting Processes" by Flemings et al., *AFS International Cast Metals Journal,* September, 1976, pp. 11–22 and "Die Casting Partially Solidified High Copper Content Alloys" by Fascetta et al., *AFS Cast Metals Research Journal,* December, 1973, pp. 167–171. In this technique the solid discrete particles comprise degenerate dendrites or nodules which are generally spheroidal in shape.

An alternative technique for providing a copper base alloy or other metal or alloy with the desired microstructure suited to semi-solid metal forming is disclosed in U.S. Pat. No. 4,415,374 to Young et al. In this patent the alloy is prepared from a solid metal composition having a directional grain structure which is heated to a temperature between its solidus and liquidus to produce a partially solid, partially liquid mixture. The mixture is then solidified to provide the desired microstructure comprising discrete spheroidal particles contained within a lower melting matrix. Finally, certain alloys by the very nature of their composition form the desired microstructure when cast without stirring or agitation. This approach is exemplified in U.S. Pat. No. 4,116,686 to Mravic et al. wherein a phosphor-bronze is provided which possesses a substantially non-dendritic grain structure in the cast condition.

In the field of copper alloys, numerous patents exist covering alloys containing additions of nickel and aluminum and in some cases silicon. U.S. Pat. Nos. 2,031,315 to Jennison, 2,789,900 to Hannon, 2,851,353 to Roach et al., and German ALS 2,309,077 to Rozenberg et al. are particularly exemplary of such alloys. Jennison discloses a copper alloy which is characterized by the absence of "birch bark" as a result of heat treatment. The alloy comprises 0.1% to 1.5% silicon, 2.0% to 6% nickel, 0.5% to 6.5% aluminum and the balance copper. Iron in a range of 0.1% to 3% is optionally added to refine the grain size. There is no discussion in Jennison of the adaptability of his alloy to forming in a semi-solid metal state or that his alloy would achieve the desired slurry forming microstructure of the alloys of this invention. Hannon discloses a copper alloy containing approximately 3.5 to 5% nickel, 0.7 to 2% silicon, 3 to 10% aluminum and a critical iron content of 1.5 to 5%. Hannon's alloys may be hot forged. There is no discussion, however, in Hannon of forging the alloy in a semi-solid state or of forming a microstructure required for slurry formation as in accordance with this invention. Roach et al. disclose copper base alloys containing 5% to 15% nickel, 0.1% to 2% silicon and 0.1% to 6% aluminum or 0.1% to 2% magnesium, or both. Roach et al. also fail to disclose the adaptability of their alloys to forming in a semi-solid state and the provision of their alloys with a microstructure suited to such a forming technique. Rozenberg et al. claim an alloy including 10 to 12% nickel, 2.2 to 2.6% aluminum, 0.8 to 1.1% silicon and 0.5 to 0.8% chromium and the balance copper. Rozenberg et al.'s alloy is not disclosed to be suited to semi-solid metal forming or to be adapted to have a microstructure as in accordance with this invention.

The following patents relate to copper-nickel alloys including additions of zinc; U.S. Pat. Nos. 1,736,654, 1,783,139, 2,101,087, 2,101,625, 2,101,626 and 3,156,539.

In addition to the aforenoted patents, numerous other patents and publications exist relating to copper-nickel-aluminum "plus" alloys as, for example, those disclosed in U.S. Pat. Nos. 3,364,016 and 3,416,915 to Mikawa, 3,635,702 to Badia et al. and 4,073,667 to Caron et al. Of less interest are believed to be those alloys disclosed in U.S. Pat. Nos. 2,034,562, 2,061,897, 2,074,604, 2,101,930, 2,144,279, 2,236,975, 2,430,419, 2,772,963, 4,401,488 and Japanese Pat. No. 53-41096. A detailed investigation of copper-nickel-aluminum alloys is described in a series of articles by Alexander et al. appearing in the *Journal Of The Institute Of Metals* at Vol. 61, Pages 83 to 102, Vol. 63, Pages 163 to 189 and Vol. 64, Pages 217 to 230.

In accordance with the present invention, a precipitation hardenable copper base alloy has been found which is particularly suited to forming the desired microstructure and adapting it to semi-solid metal slurry forming processes. The alloy is adapted to have from about 5% to about 40% liquid phase during slurry forming. The alloy consists essentially of from about 3% to about 6% by weight nickel, from about 2% to about 4.25% by weight aluminum, from about 0.25% to about 1.2% by weight silicon, from about 5% to about 15% zinc, up to about 5% iron and the balance essentially copper. The alloy has a microstructure comprising discrete particles contained in a matrix having a lower melting point than the particles. The discrete particles may comprise primary degenerate dendrites. The particles and the matrix are comprised such that when the alloy is heated to a desired temperature the alloy forms a semi-solid slurry wherein the matrix is in a molten condition comprising from about 5% to about 40% liquid and the particles are within the liquid matrix.

In accordance with a preferred aspect of the present invention, the alloy contains from about 3% to about 6% nickel, from about 2% to about 4% aluminum, from about 0.25% to about 1% silicon, from about 8% to about 10% zinc, from about 3% to about 5% iron and the balance essentially copper.

The alloys in accordance with this invention provide improved properties for semi-solid metal slurry forming techniques including having a lower melting point and a good temperature differential between its liquidus and solidus. The alloys also provide improved aging kinetics, electrical conductivity and reduced quench sensitivity. Further, when the alloys have a microstructure in accordance with this invention comprising primary solid particles contained in a matrix having a lower melting point, they have surprising formability as compared to wrought alloys of similar composition.

Alloys within the broad limits of the present invention are capable of forming the desired microstructure comprising discrete particles contained in a matrix having a lower melting point than the particles by MHD casting or any other suitable stirring technique. However, when the alloys are maintained within the preferred limits they are capable of forming the desired microstructure without stirring.

Accordingly, it is an aim of the present invention to provide an improved copper base alloy which is precipitation hardenable and which is adapted to be formed while it is in a semi-solid state.

It is a further aim of this invention to provide such an alloy having a microstructure comprising solid particles contained in a matrix having a lower melting point than the particles.

It is a still further aim of the present invention to provide an alloy as above in the forged and age hardened condition.

It is yet a further aim of the present invention to provide a cartridge case formed from an alloy as above.

These and other objects will become more apparent from the following description and drawings.

Figure 1:
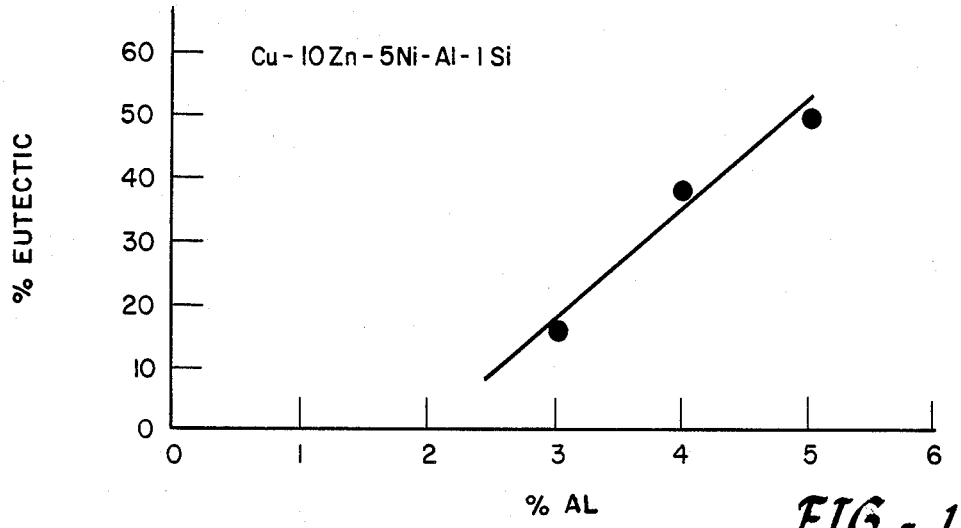
FIG. 1 is a graph showing the effect of silicon on the volume fraction of liquid in the resulting semi-solid metal slurry.

In accordance with this invention copper base alloys are provided which are adapted to be formed as a semi-solid slurry by techniques such as press forging. In the background of this application there has been briefly discussed techniques for forming semi-solid metal slurries by casting, forging, etc. Such slurries are often referred to as "thixotropic" since within certain ranges of volume fraction of liquid they behave in a thixotropic manner. Accordingly, sometimes forging of such slurries is referred to as "thixoforging" and casting of such slurries is preferred to as "thixocasting". The desired alloy microstructure in accordance with this invention can be formed by MHD slurry casting. Such a technique is sometimes referred to as "rheocasting".

The copper base alloy of the present invention is adapted to form a semi-solid slurry when heated to a temperature between its liquidus and solidus temperatures. The alloy preferably has a microstructure comprising discrete particles within a lower melting point matrix. The particles and the matrix are comprised such that when the alloy is heated to a desired temperature the alloy forms a semi-solid slurry wherein the matrix is in a molten condition comprising from about 5% to about 40% liquid and the particles are within the liquid matrix. If the alloy is formed by MHD slurry casting in accordance with the teachings of Winter et al. as set forth in the background, then the discrete particles preferably comprise degenerate dendrites or nodules which are generally spheroidal in shape. These particles comprise primary solid particles and are made up of a single phase or a plurality of phases having an average composition different from the average composition of the generally surrounding matrix in the fully solidified alloy. The discrete particles are contained in a generally surrounding matrix which is solid when the alloy is fully solidified and which is liquid when the alloy has been heated to form a semi-solid slurry. The matrix itself comprises one or more phases having a lower melting point that the discrete particles.

Conventionally solidified alloys generally have branched dendrites which develop interconnected networks as the temperature is reduced and the weight fraction of solid increases. In contrast, semi-solid metal slurries consist of discrete primary particles separated from each other by a liquid metal matrix. The primary solid particles may be degenerate dendrites in that they are characterized by smoother surfaces and a less branched structure than normal dendrites, approaching a spheroidal configuration. The surrounding solid matrix is formed during solidification of the liquid matrix subsequent to the formation of the primary solids and contins one or more phases of the type which would be obtained during solidification of the liquid alloy in a more conventional process. The surrounding matrix comprises dendrites, single or multi-phased compounds, solid solution, or mixtures of dendrites, and/or compounds, and/or solid solutions. In accordance with this invention the term "surrounding matrix" refers to the matrix in which the discrete particles are contained and it need not fully surround each particle. Therefore, the term "surrounding" should be read as generally surrounding.

Semi-solid slurries can be formed into a wide variety of possible shapes by techniques such as forging, die casting, etc. The semi-solid slurries in accordance with this invention by virtue of their structure comprising discrete particles in a molten matrix avoid problems relating to the separation of solids and liquids and thereby insure that uniform properties are obtained. The use of semi-solid slurries in press forging or die casting provides improved die life and reduced thermal shock effects during processing. In accordance with the present invention, it is possible to produce thin wall parts such as cartridge cases by press forging the alloy.

Alloys which are suited to forming in a semi-solid state must have particular combinations of properties not required for other processes such as die casting and conventional forging. For example, it is preferred that the alloys have a wide solidification range which comprises the temperature differential between the liquidus and solidus temperatures of the alloy. The alloy should preferably have from about 10% to about 30% of nonequilibrium eutectic phase so that the volume fraction of solid can be controlled upon heating the alloy to a semi-solid condition for forging. This range of volume fraction or percent of nonequilibrium eutectic phase corresponds to the range of volume percent liquid in the slurry upon heating to the semi-solid state. High fluidity of the molten alloy matrix is desired in order to minimize porosity in the finished part. Preferably, the alloy is precipitation hardenable in order to permit high strength to be attained without the necessity of cold working the resultant forged part. It is also desirable that the alloy exhibit a low quench sensitivity from the temperature at which it is solutionized before age hardening. Lower melting points for the alloy are desired to prolong die life. Improved electrical conductivity may be desired to facilitate the use of magnetohydrodynamic (MHD) stirring to form the desired cast structure. Correspondingly improved thermal conductivity is advantageous for facilitating reheating to a uniform temperature before forging.

In the background of this application, a U.S. Patent and an application to Pryor et al. have been described wherein certain copper-nickel-aluminum alloys have been formed into castings with a microstructure comprising discrete particles contained in a lower melting point matrix. Pryor et al. also disclose techniques for forming such alloys by forging into parts such as cartridge cases. In accordance with this invention it has been found that certain copper-nickel-silicon-zinc alloys have particularly improved properties for providing a precipitation hardenable alloy with a microstructure comprising discrete particles in a lower melting point matrix adapted for press forging in a semi-solid slurry condition. In particular, it has surprisingly been found that silicon and zinc when added to a copper-nickel-aluminum alloy reduce the melting point of the alloy while maintaining or increasing the solidification temperature range of the alloy. It has also been surprisingly found that silicon improves the kinetics of age hardening of the alloy and reduces the quench sensitivity of the alloy from the solutionizing temperature. Further, silicon improves the conductivity of the alloy. It has also been surprisingly found that when an alloy in accordance with the present invention is put in a condition such that it has a microstructure comprising discrete particles in a matrix having a lower melting point, then the elongation of the alloy is substantially improved as compared to the same alloy having a microstructure formed by conventional casting without stirring and hot working. Accordingly, the alloys of the present invention provide significant improvements in a number of properties important to semi-solid slurry forming techniques while maintaining comparable strength and formability of prior copper-nickel-aluminum alloys.

In accordance with this invention, a copper base alloy is provided capable of having a microstructure comprising discrete particles contained within a matrix having a lower melting point than the particles. The particles and the matrix are comprised such that when the alloy is heated to a desired temperature the alloy forms a semi-solid slurry wherein the matrix is in a molten condition comprising from about 5% to about 40% liquid and the particles are within the liquid matrix. The alloys have a composition consisting essentially of from about 3% to about 6% nickel, from about 2% to about 4.25% aluminum, from about 0.25% to about 1.2% silicon, from about 5% to about 15% zinc, up to about 5% iron and the balance essentially copper. Preferably, the composition consists essentially of from about 3% to about 6% nickel, from about 2% to about 4% aluminum, from about 0.25% to about 1% silicon, from about 8% to about 10% zinc, from about 3% to about 5% iron and the balance essentially copper.

The alloys as above having the above noted microstructure can be formed by MHD stirring techniques as described in Winter et al. patent and Pryor et al. U.S. patent and U.S. patent application although any desired technique as is known in the art could be employed for forming the alloy with the desired microstructure.

The alloy of the present invention having the desired microstructure can be formed in a semi-solid condition wherein the alloy has a volume fraction of about 5% to about 40% liquid and preferably from about 10% to about 30% liquid comprising a molten metal matrix. This minimizes significant changes in the volume fraction liquid at the forging temperature as a function of small variations in temperature. It also provides better dimensional tolerance and improved die life. After forging the alloy of this invention is preferably subjected to a heat treatment to increase its strength comprising solutionizing followed by aging. It should be possible in accordance with this invention by virtue of the reduced quench sensitivity of the alloy to combine the solutionizing and forging treatments into one, namely it should be possible to obtain the desired solutionizing effect during the time the alloy is heated above its solutionizing temperature prior to and during forging. Alternatively, if desired, in accordance with this invention the forged alloy can be separately solution treated. Solutionizing in accordance with this invention preferably is carried out by heating the alloy to a temperature of at least about 800° C. for a time period of 5 minutes to 4 hours. Preferably, the alloy is heated to a temperature in the range of 800° C. to about 950° C. for about 5 minutes to about 2 hours. After solutionizing the alloy is preferably quenched in water. If the solutionizing is carried out as part of the forging operation, then the alloy is preferably quenched immediately following forging.

After solutionizing the alloy is preferably subjected to an aging treatment wherein it is heated to a temperature in the range of from about 350° C. to about 700° C. for a time period of from about 1 minute to about 10 hours and, preferably, it is heated to a temperature of from about 400° C. to about 600° C. for about 5 minutes to about 3 hours.

When the alloys of the present invention are subjected to the aforenoted precipitation hardening treatment, they are capable of achieving a tensile strength of at least about 80 ksi.

Preferably, in accordance with this invention the alloys are formed into parts such as cartridge cases comprising thin walled elongated members. Preferably, the member has a cup-shaped configuration typical of a cartridge case. However, if desired, the alloy of the present invention can be utilized to form any desired component by the techniques which have been described.

It has previously been indicated that the volume fraction liquid when the alloy is heated to the semi-solid condition preferably should be between about 10% to about 30%. This liquid comprises in the alloy of this invention a eutectic.

Referring now to FIG. 1, a graph is shown for an alloy having a nominal composition of 10% zinc, 5% nickel, 1% silicon, with varying aluminum contents. It is apparent from this graph that aluminum has a marked effect on the volume fraction of nonequilibrium eutectic or liquid during semi-solid forming. Accordingly, the range of aluminum in accordance with this invention has been limited to from about 2% to about 4.25%.

Figure 2:
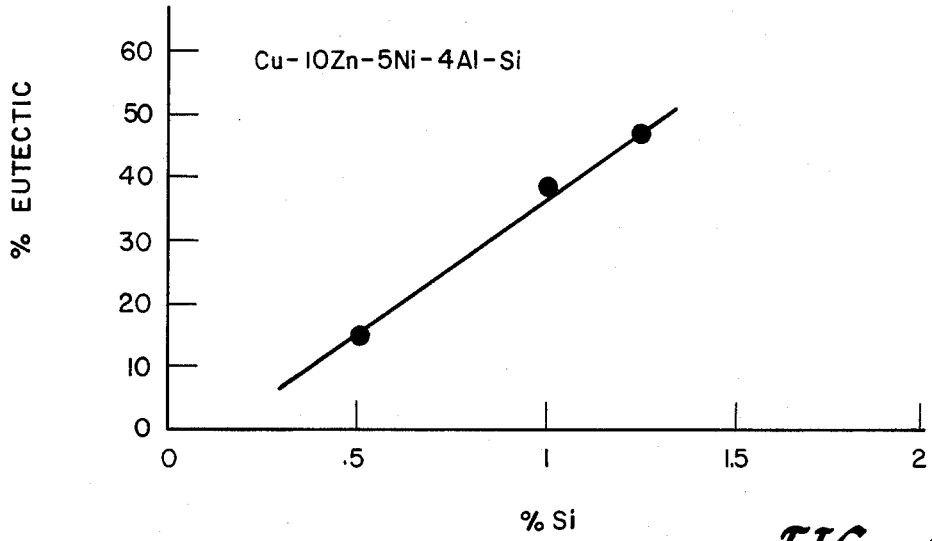
FIG. 2 is a graph showing the effect of aluminum on the volume fraction of liquid in the resulting semi-solid metal slurry.

Referring to FIG. 2, a series of alloys having a nominal composition comprising 10% zinc, 5% nickel, 4% aluminum with varying silicon contents were examined metallographically to determine the percent of nonequilibrium eutectic phase present. It is apparent from a consideration of the figure that silicon has a marked effect on the volume fraction of eutectic which is equivalent to the expected volume fraction liquid during semi-solid slurry forming. Accordingly, the silicon range in accordance with the present invention has been limited to an amount between about 0.25% to about 1.2%.

Figure 3:
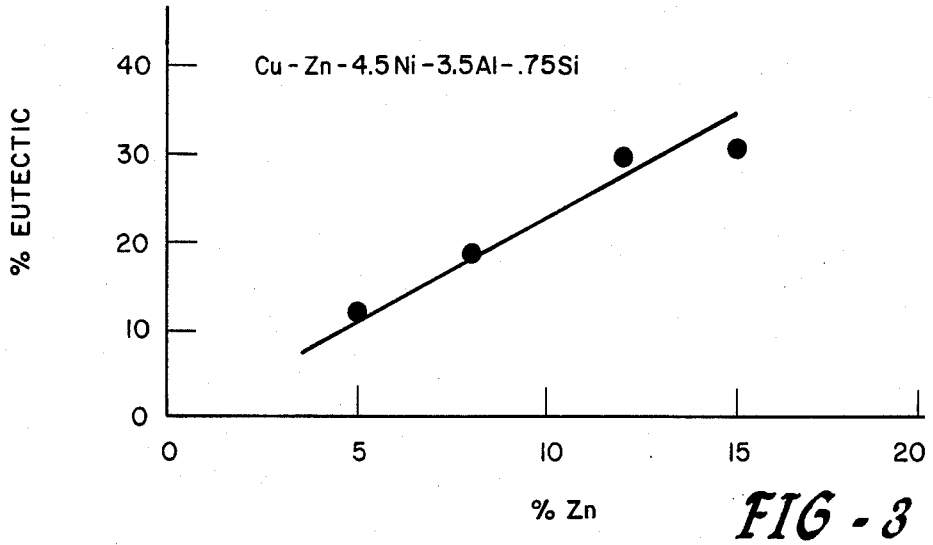
FIG. 3 is a graph showing the effect of zinc on the volume fraction of liquid in the resulting semi-solid metal slurry.

Referring to FIG. 3, a series of alloys having a nominal composition comprising 4.5% nickel, 3.5% aluminum, 0.75% silicon with varying zinc contents were examined metallographically to determine the percent of nonequilibrium eutectic phase present. It is apparent from a consideration of the figure that zinc has a marked effect on the volume fraction of eutectic or liquid during semi-solid slurry forming. Accordingly, the zinc range in accordance with the present invention has been limited to an amount between about 5% to about 15%.

The nickel content of the alloy does not substantially affect the volume fraction of nonequilibrium eutectic or liquid phase present. However, it has a major effect on the aging characteristics of the alloy particularly the strength which can be achieved. Accordingly, the nickel range, in accordance with the present invention, has been limited to an amount between about 3% to about 6%. The lower limit has been determined by the strength requirements for the alloy and the upper limit has been established by the mix value of the alloy since it is desired to minimize the expense of the resultant alloy.

In accordance with the preferred embodiment of the present invention, iron is added to the alloy so that the alloy can be cast without stirring and yet be capable of forming the desired microstructure comprising discrete particles in a lower melting point matrix. When iron is added to the alloy to make it castable without stirring, the ranges of the other elements in the alloy must be controlled within critical limits. The iron range in accordance with the preferred embodiment has been limited to an amount between about 3% to about 5% iron. When less than 3% iron is included in the alloy, a columnar dendritic structure is promoted. It has been found that the addition of 2% iron produced all columnar dendritic structure in a Cu-10%Zn-4%Al-0.75%Si-5%Ni alloy. When more than 5% iron is included in the alloy, a mixed structure results including undesirable dendrites. Maintaining the iron content within the range of 3% to about 5% should provide the desired structure. The nickel content for the preferred alloy should be maintained in the range of from about 3% to about 6%. Nickel contents of 7% were found to form dendrites.

The nickel and iron contents are interrelated with respect to forming an alloy capable of achieving the desired microstructure. It has been found, for example, that for a 5% nickel alloy, otherwise within the ranges of this invention, a minimum of 3% iron is required. It is believed that a ratio of iron to nickel of at least about 0.5 (0.5:1) and, preferably, at least about 0.6 (0.6:1) it is necessary to obtain a desired microstructure upon casting without stirring. This has been confirmed by comparison with an alloy having 7% nickel and 3% iron with all other elements within the ranges of this invention which produced an as-cast dendritic structure. However, when the iron content of the alloy was increased to 5% meeting the minimum ratio, the desired microstructure was achieved as cast. The iron-nickel ratio also depends upon cooling rate in the semi-solid state. The ratio set forth hereinbefore holds for cooling rates characteristic of chill castings of rods or plates less than ¾" thick. For slower cooling rates as would be expected with a chill casting at least 2" wide the minimum ratio should be increased to about 0.9 (0.9:1) and, preferably, at least about 1 (1:1).

The range for zinc in accordance with the preferred embodiment of the invention is from about 8% to about 10%. An alloy as cast without agitation having 12% zinc and otherwise being within the ranges of this embodiment produced a mixed structure including undesirable dendrites. A similar as-cast alloy at 15% zinc was columnar dendritic. Similarly, an alloy having 5% zinc resulted in a mostly columnar dendritic structure.

Aluminum in accordance with the preferred embodiment should be within the range of from about 2% to about 4%. Lower aluminum contents do not provide sufficient strength. Higher aluminum contents promote the formation of equiaxed dendrites.

Silicon in accordance with the preferred embodiment of this invention should be within the range of about 0.25% to about 1%. It has been found that silicon in the lower part of the range results in finer particulates in the microstructure. "Particulate" as the term is used herein comprises a discrete particle with its surrounding matrix. However, decreasing silicon results in longer aging times and slightly inferior hardness and strength.

If it is desired to achieve high strength in a reduced heat treatment time as, for example, 1 hour at 550° C., then the composition range for the alloys of this embodiment should most preferably consist essentially of from about 8% to about 10% zinc, from about 4% to about 6% nickel, from about 3% to about 4% aluminum, from about 0.5% to about 1% silicon, from about 3% to about 5% iron and the balance essentially copper. Decreasing the nickel, aluminum or silicon contents below the most preferred limits results in longer aging treatments and reduced hardness although the alloy would still be precipitation hardenable.

Forging in accordance with this invention is normally carried out in the semi-solid condition and coarsening of the particulates may occur during reheating to the semi-solid condition. This is undesirable from a forging point of view. It has surprisingly been found that no significant growth in the particulate size of the alloys of this invention results and that coring is significantly reduced by casting the alloys without stirring.

Referring again to the broad aspects of the present invention, Table I shows the effect of zinc on the melting point and solidification range of the alloy. It is apparent from a consideration of Table I that the addition of zinc significantly decreases the solidus temperature. This decrease in solidus temperature does not occur at the expense of decreasing the solidification temperature range ΔT. Further the alloys of this invention show very wide solidification temperature ranges as compared to the other alloys shown in Table I.

TABLE I

Solidification Behavior of Cu—Zn—Ni—Al (—Si) Alloys

| Composition (wt. pct.) | | | | Melting Points (°C.) | | | Estimated Fraction of Liquid Phase on Reheating |
|---|---|---|---|---|---|---|---|
| Zn | Ni | Al | Si | $T_L$ | $T_S$ | ΔT | to semi-solid |
| — | 5 | 7 | — | 1073 | 1042 | 31 | 0.39 |
| — | 5 | 7 | 1 | 1040 | 1008 | 32 | 0.40 |
| 15 | 5 | 5 | — | 1006 | 982 | 24 | 0.31 |
| 10 | 5 | 4 | — | 1045 | 1004 | 41 | 0.28 |
| 10 | 5 | 5 | 1 | 1000 | 968 | 32 | 0.50 |
| 10 | 5 | 4 | 1 | 1010 | 963 | 47 | 0.38 |
| 10 | 5 | 3 | 1 | 1020 | 980 | 41 | 0.16 |
| — | 10 | 7.5 | — | 1085 | 1060 | 25 | 0.35 |
| 10 | 10 | 2 | — | 1094 | 1051 | 43 | 0.39 |
| 20 | 10 | 2 | — | 1050 | 992 | 58 | 0.37 |

Referring again to the preferred embodiment of the present invention, one pound chill castings ½" thick were prepared of a series of alloys having the following composition: Cu-10%Zn-5%Ni-4%Al-0.75%Si-3 to 5%Fe. The alloys as cast without stirring had a fine particulate microstructure in accordance with this invention. Tensile tests were performed on these castings in the as-cast condition and after heat treatment at 550° C. for 1 hour. The results are set forth in Table II.

TABLE II

| | As-Cast Condition | | | Aged at 550° C./1 hr | | |
|---|---|---|---|---|---|---|
| Alloy | Yield ksi | UTS ksi | % E | Yield ksi | UTS ksi | % E |
| Cu—10Zn—5Ni—4Al—3Fe—0.75Si | 45 | 85 | 35 | 73 | 106 | 18 |
| Cu—10Zn—5Ni—4Al—4Fe—0.75Si | 43 | 86 | 30 | 76 | 109 | 9 |
| Cu—10Zn—5Ni—4Al—5Fe—0.75Si | 41 | 90 | 28 | 71 | 106 | 16 |

Referring to Table II, it is apparent that the alloys of the preferred embodiment of this invention can achieve excellent mechanical properties in the aged condition which would make them suitable for applications such as cartridge cases. Further, the alloys come close to achieving the necessary properties in the as-cast condition itself.

Referring to Table III, a series of alloys were cast without stirring having the composition set forth in the table. The hardness of the alloys was measured in the as-cast condition and after heat treatment at 550° C. for 1 hour and after heat treatment at 550° C. for 2 hours.

TABLE III

Vicker Hardness of Cu—Zn—Ni—Al—Fe—Si Alloys

| Alloy # | Alloy | As-cast | 550° C./1 hr | 550° C./2 hrs |
|---|---|---|---|---|
| 1 | Cu—10Zn—5Ni—4Al—3Fe—0.75Si | 151 | 220 | 215 |
| 2 | Cu—8Zn—5Ni—4Al—3Fe—0.75Si | 163 | 230 | 227 |
| 3 | Cu—10Zn—2Ni—4Al—3Fe—0.75Si | 108 | 127 | 145 |
| 4 | Cu—10Zn—4Ni—4Al—3Fe—0.75Si | 142 | 228 | 222 |
| 5 | Cu—10Zn—6Ni—4Al—3Fe—0.75Si | 185 | 245 | 237 |
| 6 | Cu—10Zn—5Ni—2Al—3Fe—0.75Si | 153 | 159 | 227 |
| 7 | Cu—10Zn—5Ni—3Al—3Fe—0.75Si | 169 | 232 | 222 |
| 8 | Cu—10Zn—5Ni—4Al—4Fe—0.75Si | 162 | 225 | 222 |
| 9 | Cu—10Zn—5Ni—4Al—5Fe—0.75Si | 158 | 229 | 219 |
| 10 | Cu—10Zn—5Ni—4Al—3Fe—1Si | 198 | 242 | 243 |
| 11 | Cu—10Zn—5Ni—4Al—3Fe—0.5Si | 150 | 245 | 245 |
| 12 | Cu—10Zn—5Ni—4Al—3Fe—0.25Si | 138 | 159 | 227 |

The results set forth in Table III clearly demonstrate the excellent properties achievable with the alloys in accordance with the most preferred aspects of this invention. For example, Alloy 3 having a low nickel content outside the ranges of the alloys of this invention provides relatively low strength and limited aging response. Alloy 12 having a relatively low silicon content outside the preferred range also provides reduced strength, however, a longer term aging response is demonstrated. Similarly, Alloy 6 having aluminum at the low end of the range provides reduced strength, however, a longer term aging response is demonstrated.

Referring now to Table IV, an alloy in accordance with this invention having Cu-10%Zn-5%Ni-4%Al-3%Fe0.75%Si was treated as set forth in the table. In particular, the alloy was aged for 1 hour and 2 hours, respectively, in the as-cast without stirring condition. Other samples of the alloy were reheated to the semi-solid condition and then water quenched. Still other samples were reheated to the semi-solid condition and air cooled.

TABLE IV

| Condition | 550° C./1 hr | 550° C./2 hrs |
|---|---|---|
| Cast | 220 | 215 |
| Reheated + WQ | 261 | 250 |
| Reheated + Air Cooled | 234 | 225 |

The results shown in Table IV clearly demonstrate that the reheated and cooled samples provided higher hardnesses than the cast and aged samples with the best results being achieved by a water quench. It was also found that the particulates did not substantially coarsen upon the reheating.

The alloys described in the hereinbefore examples were all cast from 1200° C. The alloys in accordance with the preferred embodiment exhibited the desired microstructure in the as-cast without stirring condition. It has surprisingly been found the casting temperature influences the as-cast without stirring structure with respect to alloys of the preferred embodiment. To illustrate this, alloys having Cu-10%Zn-5%Ni-4%Al-3%Fe-0.75%Si were cast from temperatures varying from 1100° to 1300° C. in increments of 50° C. The desired microstructure was achieved in the as-cast castings made at 1100° C., 1150° C. and 1200° C. However, the castings at 1250° C. and 1300° C. resulted in microstructures including undesired equiaxed dendrites. Accordingly, it is preferred in accordance with this invention to cast the alloys of the preferred embodiment at temperatures up to about 1200° C.

The alloys of this invention comprise predominately alpha phase alloys. Alpha phase alloys have the advantage of high ductility in the as-cast and forged conditions with comparatively low strength so that additional forming operations can be performed without difficulty. The alloys can be heat treated after forming to high strengths and still retain very good ductilities.

All compositions set forth herein are percentage by weight.

The alloys in accordance with this invention may include other elements which do not significantly affect their properties or their ability to form the desired microstructure. Further, the alloys may have other elements in impurity amounts which do not materially affect their characteristics.

The patents, patent applications and articles set forth in this specification are intended to be incorporated by reference herein.

It is apparent that there has been provided in accordance with this invention an alpha copper base alloy adapted to be formed as a semi-solid metal slurry which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A copper base alloy adapted to have a a structure comprising a plurality of discrete particles in a surrounding metal matrix, said particles and said matrix being comprised such that when said alloy is heated to a desired temperature said alloy forms a semi-solid slurry wherein the matrix is in a molten condition comprising from about 5% to about 40% liquid and said particles are within said liquid matrix, said alloy consisting essentially of from about 3% to about 6% nickel, from about 2% to about 4.25% aluminum, from about 0.25% to about 1.2% silicon, from about 5% to about 15% zinc, up to about 5% iron and the balance essentially copper.

2. A copper base alloy as in claim 1 wherein said aluminum content is from about 2% to about 4%, wherein said zinc content is from about 8% to 10%, wherein said silicon content is from about 0.25% to about 1% and wherein said iron content is from about 3% to about 5%; whereby said alloy is capable of forming said structure upon casting without stirring.

3. A copper base alloy as in claim 2 wherein the minimum ratio of iron to nickel varies from at least about 0.5 to at least about 0.9 and wherein said ratio is related to a cooling rate during casting of said alloy with the minimum ratio increasing as the cooling rate from casting decreases.

4. A copper base alloy as in claim 3 wherein said ratio is from at least about 0.6 to at least about 1.

5. A copper base alloy as in claim 1 having said structure wherein said alloy is in a stir cast condition having said structure.

6. A copper base alloy as in claim 5 wherein said alloy is in a stir cast and forged from said semi-solid slurry condition.

7. A copper base alloy as in claim 6 wherein the alloy is further in an aged hardened condition.

8. A copper base alloy as in claim 1 wherein said matrix at said desired temperature comprises from about 10% to about 30% liquid.

9. A copper base alloy as in claim 1 wherein said discrete particles comprise degenerate dendrites having a generally spheroidal shape.

10. A copper base alloy as in claim 2 wherein said alloy is in an as-cast without stirring condition having said structure.

11. A copper base alloy as in claim 10 wherein said alloy is in a forged from said semi-solid condition.

12. A copper base alloy as in claim 11 wherein said alloy is further in a precipitation hardened condition.

13. A copper base alloy as in claim 2 wherein said matrix at said desired temperature comprises from about 10% to about 30% liquid.

* * * * *